US005593212A

United States Patent [19]

Praria et al.

[11] Patent Number: 5,593,212

[45] Date of Patent: Jan. 14, 1997

[54] FOOTSTOOL EXTENSION PROVIDING LEG SUPPORT

[76] Inventors: Helen T. Praria; Guy B. Praria, both of 14 George St., Wayland, Mass. 01778

[21] Appl. No.: 452,892

[22] Filed: May 30, 1995

[51] Int. Cl.[6] ..... A47C 16/02

[52] U.S. Cl. ..... 297/423.44; 297/423.46; 297/217.3; 297/452.41; 108/143; 601/15

[58] Field of Search ..... 297/180.12, 180.15, 297/217.3, 233, 423.21, 423.27, 423.36, 423.39, 423.41, 423.44, 423.46, 452.41; 601/15, 22, 98; 603/108, 111, 144; 108/138, 143; 248/918

[56] References Cited

U.S. PATENT DOCUMENTS

| | | | |
|---|---|---|---|
| 697,279 | 4/1902 | Schmied | 297/452.41 X |
| 1,049,779 | 1/1913 | Taussig | 297/423.14 |
| 2,600,759 | 6/1952 | Gross | 297/233 X |
| 4,159,714 | 7/1979 | Peterson et al. | 601/15 |
| 4,258,706 | 3/1981 | Shank | 297/180.15 X |
| 4,513,736 | 4/1985 | Thurber | 601/15 X |
| 4,588,229 | 5/1986 | Jay | 297/452.41 |
| 5,054,144 | 10/1991 | Stuart et al. | 297/423.44 X |
| 5,411,468 | 5/1995 | Chen | 297/217.3 X |

FOREIGN PATENT DOCUMENTS

| | | | |
|---|---|---|---|
| 1541071 | 2/1979 | United Kingdom | 297/452.41 |

*Primary Examiner*—Peter R. Brown

[57] ABSTRACT

A footstool extension comprising a leg support assembly attachable to a footstool. In the preferred embodiment the leg support assembly comprises a platform, of a size and shape to correspond to the footstool to which it is attached and made of wood, plastic or other such material, with a pad or cushion covered with a suitable fabric, leather, plastic, or other covering attached to the top surface of the platform, and with the platform slideably mounted on one or more rails or runners bendably attachable to the footstool. A folding prop or brace is bendably attached to the rails allowing the leg support assembly to be folded out of the way when not in use.

In other embodiments the pad or cushion is filled with a fluid or gel resulting in a more comfortable cushion that can be heated or cooled to provide some therapeutic value. An oscillator or vibrator can also be coupled to the gel filled cushion to gently massage the user's legs and/or feet.

6 Claims, 2 Drawing Sheets

FIG. 1
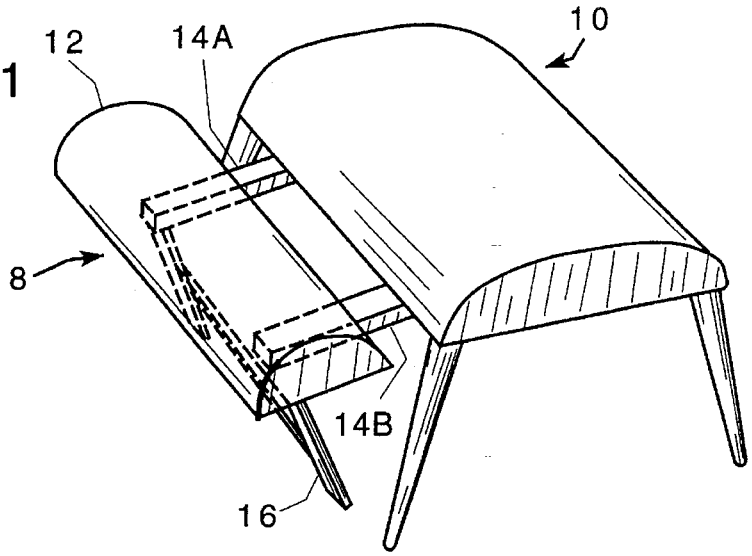
FIG. 2
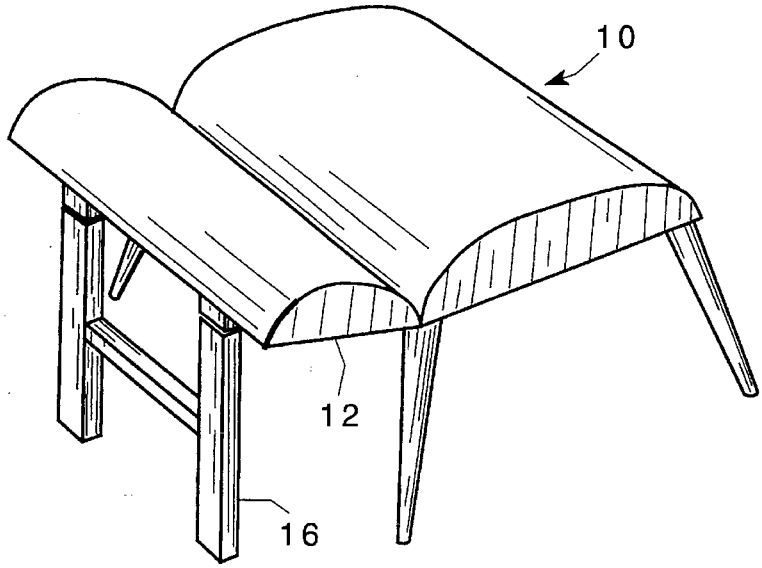
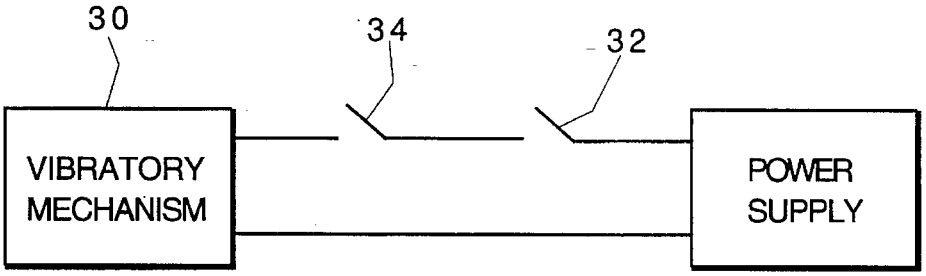
FIG. 5

FOOTSTOOL EXTENSION PROVIDING LEG SUPPORT

BACKGROUND

1. Field of the Invention

This invention relates to footstools, hassocks, or other such footrests by providing an extension to support the user's legs and fluid or gel filled cushions on either the extension or the footstool or both.

2. Discussion of Prior Art

Heretofore, footstools consisted almost exclusively of small, raised platforms either unpadded or padded with horsehair, cotton, rubberized foam, or other such materials. Such devices serve to elevate the feet and, when padded, to soften somewhat the point of contact but do nothing to spread the point of contact or to support the user's legs. This often results in aches and pains in the user's knees. Some reclining chairs have included a section between the seat and the footrest as a leg support but to date there have been no such additions to footstools.

When the footstool is lower than the edge of the couch or chair that the user is sitting on, the edge of the couch or chair provides some support for the user's thighs. This support, however, is usually a rather stiff edge and, with prolonged use, tends to cut circulation to the user's legs causing some discomfort. When the footstool is not lower than the couch or chair, the user's legs are supported only at the hips and feet causing a strain on the underside of the knees. In addition, different users will sink into a couch or chair by different amounts because of the wide variations in weight from one user to another. This will cause the angle, formed by the user's legs to the horizontal, to differ from user to user as well as from chair to chair. This invention corrects these problems by providing the footstool with an adjustable support for the lower legs thereby affording greater comfort. By adjusting the angle of the support it can be made to match the angle of the user's legs thereby equalizing the pressure of the hips, legs and feet.

There are also wide variations in user's leg lengths, requiring the footstool to be placed at greater or lesser distances from the chair or couch for different users. This invention compensates for these variations by allowing the adjustable support to be extended toward the user and away from the footstool for users with long legs or retracted close to the footstool for users with shorter legs.

The cushioning material used in prior art is generally quite firm because it is intended to support the user's heels. This invention provides additional comfort by means of a fluid or gel filled cushion. Such a cushion will conform to the shape of the user's legs or feet thereby making contact with a much greater surface of the user's legs or feet than an ordinary foam filled cushion or other such pad. The greater the area of contact between the cushion and the user's legs, the lower the pressure per square inch and, therefore, the greater the comfort.

The resilient foot rest in U.S. Pat. No. 5,318,495 to Malynowsky, 1994 Jun. 7, describes a method of stimulating the circulation of the lymphatic system with minimal exertion by the user. This is intended to be accomplished by the user extending a spring by pushing downward with his or her foot and allowing the spring to oscillate moving the user's leg with it. Because the spring can only dissipate the energy put into it this method uses as much effort as would be needed to turn bicycle pedals. A fluid or gel filled cushion, however, allows the inclusion of an oscillatory or vibratory mechanism to be coupled to the footstool and/or the leg support pad or cushion. Such an oscillatory or vibratory mechanism would not only relax and soothe the muscles to ease tired or cramped legs or feet but would also tend to improve circulation of blood and the lymphatic system. A vibrator would be ineffective with the cushions used with prior art because the padding used would tend to dampen or absorb the vibrations. A fluid or gel filled cushion, however, will not only transmit the vibrations very efficiently and effectively but can also be made to modify them.

Additionally, by making the fluid or gel filled cushion removable it can be heated or cooled separately and then reinserted to provide further therapeutic value. Even if the pad or cushion used in prior art were made to be removable the materials used will not retain heat or cold.

OBJECTS AND ADVANTAGES

Accordingly, an object of this invention is to provide a more comfortable footrest by replacing the usual pad or cushion found on a conventional footstool with a fluid or gel filled cushion.

In addition, an object of this invention is to provide support for the legs of anyone using a footstool or hassock or other type of footrest by furnishing a pad or cushion between the footstool and the user's chair or couch thereby reducing the strain on the user's legs and affording greater comfort.

Another object is to provide support for the legs of anyone using a footstool or hassock or other type of footrest with such leg support having the height of the upper surface of the leg support member adjustable to accommodate the variations in position among users and among chairs or couches or other types of seats.

Another object is to provide support for the legs of anyone using a footstool or hassock or other type of footrest, with such leg support having the distance between the leg support member and the footstool adjustable to accommodate the variations in the length of user's legs.

Another object is to provide a fluid or gel filled cushion on the upper surface of the footstool and/or the leg support member thereby spreading the support area and increasing the degree of comfort.

A further object is to provide a removable, fluid or gel filled cushion on the upper surface of the footstool and/or the leg support member such that the cushion can be removed, heated or cooled, and then replaced to provide some therapeutic value.

A still further object is to provide support for the legs of anyone using a footstool or hassock or other type of footrest, with such leg support having an oscillatory or vibratory means of inducing relaxation and improving circulation.

And yet another object is to provide support for the legs of anyone using a footstool or hassock or other type of footrest, with such leg support capable of being folded out of the way when not in use.

Further objects and advantages of our invention will become apparent from a consideration of the drawings and ensuing description.

DESCRIPTION OF DRAWINGS

FIG. 1 is a perspective view of one embodiment of our invention showing the leg support assembly attached to a footstool with the leg support member extended and partially raised.

FIG. 2 is a perspective view with the leg support member fully raised but not extended showing the way that the brace will support the leg support member.

FIG. 5 is a wiring diagram showing the operation of the vibratory mechanism.

| | |
|---|---|
| 8 Leg support assembly | 10 Footstool |
| 12 Leg support member | 14A, 14B Rails |
| 16 Brace | 18A, 18B Brace mounting hinges |
| 20A, 20B Rail mounting hinges | 22 Cushion |
| 24 Leg support platform | 26A, 26B Slidable retainers |
| 28 Mounting Screws | 29 Spaced openings |
| 30 Vibratory mechanism | 32 Power switch |
| 34 Pressure switch | 36 Gel filled cushion |
| 38 Removable cover | |

DESCRIPTION OF INVENTION

In the preferred embodiment the leg support assembly comprises:

1. a platform, of a size and shape to correspond to the footstool to which it is attached and made of wood, plastic, or other such material;
2. a pad or cushion covered with a suitable fabric, leather, plastic, or other covering attached to the top surface of the platform thus forming a leg support member;
3. two parallel rails or runners providing a slidable surface for the leg support member;
4. a bendably attached brace to hold the rails or runners in position; and,
5. hinges, brackets, or other means of bendably attaching the rails or runners to a footstool or other footrest.

The leg support member is slideably mounted on rails or runners equal in length to their mounted height from the floor. The rails are bendably attached to the footstool. A folding prop or brace, equal in length to the rails, is bendably attached to the near ends of the rails.

The illustrations show the leg support member slideably attached to rails bendably or otherwise attached to the footstool. The leg support member could just as easily be firmly attached to the rails with the rails being slideably attached to the footstool. Additionally, the prop or brace is shown attached to the rails or to the leg support member. A prop or brace could be attached to the underside of the footstool or to the leg or legs of the footstool or it could be otherwise mounted.

FIG. 1 shows a perspective view of one embodiment of our invention comprising a footstool 10 with a leg support assembly 8 attached to it. Leg support member 12 is shown in the fully extended position on rails 14A and 14B and raised far enough to illustrate the action. Rails 14A and 14B are attached to the underside of footstool 10 by bendable attachments such as hinges 20A and 20B (shown in FIG. 3) on the far ends of rails 14A and 14B. Footstool 10 is shown as being square with four legs for the purposes of illustration only; it can be round, square or any other shape with any number of legs or even no legs. In FIG. 2, leg support member 12 is fully raised but not extended. Leg support member 12 is held in position by a brace 16.

Figure 3:
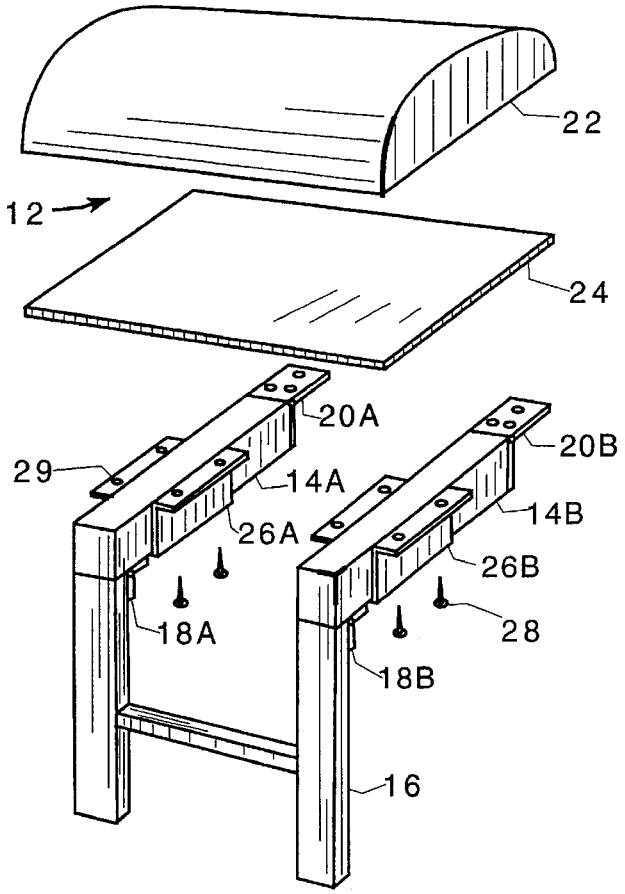
FIG. 3 is an exploded view of the leg support assembly showing the component parts.

As shown in FIG. 3 the upper end of brace 16 is fastened to rails 14A and 14B by bendable attachments such as hinges 18A and 18B. The lower end of brace 16 is allowed to rest on the floor. Leg support member 12, comprising a pad or cushion 22 attached to a leg support platform 24, is placed on top of rails 14A and 14B and secured by slidable retainers 26A and 26B. Four spaced openings 29 are formed in each of slidable retainers 26A and 26B. Screws 28 or other such fasteners extend through spaced openings 29, in slidable retainers 26A and 26B, into platform 24 to retain platform 24 on rails 14A and 14B such that leg support member 12 can slide back and forth on rails 14A and 14B without being removed. Cushion 22 can be attached to platform 24 using any of several adhesives, or with a wraparound covering of plastic, leather, fabric or other material or by any other suitable method. If desired, a retaining catch (not shown) can be fitted to the back of platform 24 in such a location as to engage a retaining stud (not shown) mounted on brace 16 when leg support assembly 8 is in a folded position thereby maintaining the folded position.

Fixed or removable fluid or gel filled cushions can be used with either footstool 10 itself or leg support member 12 to add further comfort or therapeutic value and to allow the use of an oscillatory or vibratory mechanism. An example of such a fluid or gel filled cushion is shown in FIG. 4, an exploded view of leg support member 12.

Figure 4:
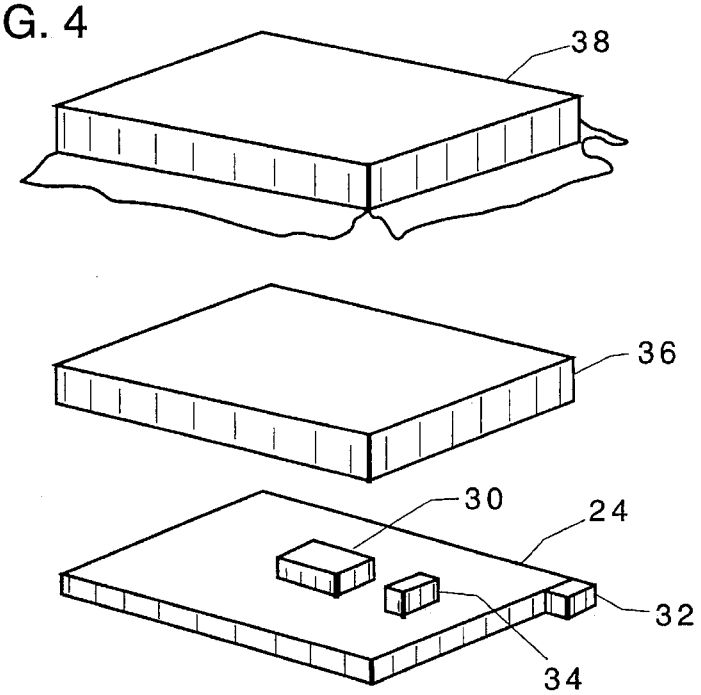
FIG. 4 is an exploded view of the leg support member with the original pad or cushion replaced with a fluid or gel filled pad or cushion.

FIG. 4 shows platform 24, a vibratory mechanism 30, a power switch 32, a pressure switch 34, a gel filled cushion 36 that replaces cushion 22 (shown in FIG. 3), and a removable cover 38. Cushion 36 can be filled with essentially any fluid such as, but not limited to, water, glycerin, oil, etc., or any of the many gels in common use today such as, but not limited to, CRYO-GEL refrigerant. CRYO-GEL is a trade mark of Reliable Plastics, Dunellen, N.J. Vibratory mechanism 30, power switch 32, and pressure switch 34 are permanently fastened to platform 24. Cushion 36 is laid on top of the assembly and held in place with removable cover 38. Cover 38 can be held in place by any of several methods such as zippers, snaps, hooks, elastics, etc., and, therefore, the means of retaining cover 38 are not shown. The vibratory mechanism used in this embodiment comprises a solenoid, mounted vertically, with the plunger non-magnetically connected to a flat plate that is free to move and is in intimate contact with the gel filled cushion. A switch, in series with the solenoid and operated by contact with the flat plate, interrupts the current through the solenoid when the plunger is pulled in and re-makes contact to continue the current when the weight of the gel pushes the plunger back thereby causing a vibratory action. However, because there are many different vibratory mechanisms available and since the actual mechanism of the vibrator is not a part of this invention, the actual workings of the vibrator are not shown. It is shown simply as a box in FIG. 4 and as a block in FIG. 5. In the same way, there are many pressure switches and power switches that could be used and, therefore, they are shown simply as boxes in FIG. 4 and symbolically in FIG. 5.

FIG. 5 is a wiring diagram showing the circuit used to power the vibratory mechanism. Power can be supplied by a battery or by ordinary household current and therefore the power source is shown symbolically as a block.

OPERATION OF INVENTION

In use, leg support member 12 is simply lifted allowing the free end of brace 16 to rest on the floor. If member 12 is lifted only part way, brace 16 will be at an angle to the floor. In this case, member 12 will be lower than footstool 10 and at some angle as shown in FIG. 1. This position can be used when footstool 10 is higher than the chair or couch. So long as the angle between brace 16 and the floor is greater than about 45 degrees brace 16 will hold member 12. When member 12 has been raised to the required height it can be pulled out from footstool 10 and allowed to rest on brace 16.

If member 12 is lifted high enough for brace 16 to be at right angles to the floor, the thickness of rails 14A and 14B will raise the near end of member 12 somewhat higher than the far end. This will cause member 12 to slope downward toward footstool 10 providing leg support when footstool 10 is lower than the chair or couch. Member 12 can be slid out as needed to adapt the support to the user's legs. Alternatively, telescoping legs on brace 16, or notches in the legs of footstool 10, or any of a variety of other methods can be used to provide stops for brace 16. In this way, member 12 can be held in almost any position.

When not in use member 12 is slid back against footstool 10 and brace 16 is pushed out from under member 12 to allow member 12 to drop to a vertical hanging position in front of footstool 10. Various retaining methods, such as a retaining catch (not shown) fitted to the back of member 12 and used to engage a retaining stud (not shown) on brace 16, can be used to hold member 12 and brace 16 off the floor when footstool 10 is to be moved.

A further embodiment comprises the device described in the preferred embodiment with cushion 22 replaced with cushion 36 (shown in FIG. 4) filled with a fluid or gel. Cushion 36 can provide a conforming cushion for the user's legs and/or feet and can act as an interface between vibratory mechanism 30 and the user's legs and/or feet thereby giving greater support and comfort. Removable cover 38 can be used to hold cushion 36 in place without preventing cushion 36 from being removed. If it is made to be removable, cushion 36 can be heated or cooled and used to provide some therapeutic value.

Additionally, vibratory mechanism 30, in intimate contact with cushion 36, would serve to soothe and relax the user's muscles and improve circulation. A fluid or gel filled cushion would couple the vibrations to the user's legs more efficiently and more effectively than could be coupled by horse hair, rubber or other such padding. Although the gel is pliable and will give way under the weight of the user's legs, it is incompressible and will therefore conduct the compressions and rarefactions of a vibratory mechanism efficiently and effectively. By adjusting the frequency of the vibrations to the resonant frequency of the cushion or to a harmonic of the resonant frequency, waves can be formed to stimulate blood flow and lymphatic circulation. In this way, waves can be created much like those in a whirlpool bath. Power switch 32 can be used to connect power to vibratory mechanism 30 when vibrations are wanted. Pressure switch 34, operated by the weight of the user's leg, can be used to turn the power on or off as the user's leg or legs are placed on or off member 12. This will conserve power; especially an advantage when battery power is used.

A liquid or gel filled cushion will also retain heat or cold. By removing cushion 36 and heating or cooling it, it can be used to ameliorate the aches and pains of some injuries. In the case of a twisted ankle or bruised leg, for instance, cushion 36 can be removed, cooled in the refrigerator or freezer, and then reinserted. When the user places his or her injured leg or ankle on cushion 36 the cold will ease the pain, inhibit the swelling, and retard the discoloration.

CONCLUSION, RAMIFICATIONS AND SCOPE

Thus it can be seen that the described invention can provide greater comfort as well as some therapeutic value. While the above description contains many specificities, these should not be construed as limitations on the scope of the invention, but rather as an exemplification of a preferred embodiment thereof.

Various other embodiments are also possible. If, for instance, member 12 is firmly attached to a rail or rails slideably attached to footstool 10, member 12 could have a greater range of extension. Various types of braces could be used to hold member 12 in position. An oscillatory or vibratory mechanism could be used in member 12 or in footstool 10 itself or both. Removable fluid or gel filled pads or cushions could be used in member 12 or in footstool 10 or both.

The preferred embodiment is described as it is because it is expected to get the greatest usage. Simpler embodiments may be less expensive but also have less functionality. The more complex embodiments have greater functionality but suit a more limited market. Accordingly, the scope of the invention should be determined not by the embodiments illustrated, but by the appended claims and their legal equivalents.

We claim:

1. A footstool appendage comprising:

a) a pad or cushion mounted on, b) a platform of suitable size and shape to accommodate use by a human resting his or her legs, c) at least one rail made of relatively rigid material having sufficient width and thickness to support the weight of the legs and/or feet of a human and having a length somewhat greater than the width of said platform, one end of which is attached to a footstool, d) at least one U shaped bracket with outwardly extending flanges, said at least one U-shaped bracket being sized to fit closely but not tightly around said at least one rail and attached by screws, bolts, or other such fasteners through said flanges to the underside of said platform, such that when said at least one rail is attached to said footstool, and said flanged brackets placed around said at least one rail and attached to the underside of said platform is capable of sliding back and forth on said at least one rail thereby allowing said platform to be extended greater or lesser distances from the footrest to accommodate users of different sizes and allowing placement of said platform where it will be most effective.

2. The appendage in claim 1 with said at least one rail having at said one end, a hinge or other pivotal means of attachment to said footstool and, at the other end, a pivotal means of attachment to a brace with said brace being of a length slightly greater than the height above the floor of the point of attachment of said at least one rail to the footstool such that, when the point of contact between said brace and the floor is directly under the point of attachment of said brace to said at least one rail, said platform will be inclined downward toward the footstool and, as the point of contact between the brace and the floor is moved back toward the footstool, the angle of the platform will go from sloping downward, through the horizontal, to sloping upward relative to the footstool thereby allowing adjustment of the height and angle of said platform to optimize the comfort of the user and, at its extreme, to a relatively perpendicular position in front of the footstool, effectively being folded out of the way.

3. The footstool appendage in claim 2 with a vibratory means coupled to said pad or cushion thereby providing a means of gently massaging the user's legs.

4. The footstool appendage in claim 2 with a fluid or gel filled pad or cushion mounted to said platform such that said pad or cushion can conform to the shape of the user's leg thereby forming a better interface between said platform and the users legs affording greater comfort and allowing a more efficient transfer of heat, cold, or vibration.

5. The footstool appendage in claim 4 with a vibratory means coupled to said pad or cushion thereby providing a means of gently massaging the user's legs.

6. The footstool appendage in claim 5 with a switching means, operated by the weight of the user's legs, to cause said vibratory means to be turned on when said pad or cushion is in use and to be turned off when it is not in use.

* * * * *